US010745631B2

(12) United States Patent
Frey et al.

(10) Patent No.: US 10,745,631 B2
(45) Date of Patent: Aug. 18, 2020

(54) HYDROPROCESSING UNIT WITH POWER RECOVERY TURBINES

(71) Applicant: UOP LLC, Des Plaines, IL (US)

(72) Inventors: Stanley Joseph Frey, Palatine, IL (US); James W. Harris, Palatine, IL (US); Michael Van de Cotte, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 214 days.

(21) Appl. No.: 15/923,978

(22) Filed: Mar. 16, 2018

(65) Prior Publication Data

US 2019/0284488 A1 Sep. 19, 2019

(51) Int. Cl.
*C10G 65/12* (2006.01)
*F01K 25/14* (2006.01)

(52) U.S. Cl.
CPC ..... *C10G 65/12* (2013.01); *F01K 25/14* (2013.01); *C10G 2300/202* (2013.01); *C10G 2300/4081* (2013.01)

(58) Field of Classification Search
CPC ..... C10G 65/02; C10G 2300/4081
See application file for complete search history.

(56) References Cited

U.S. PATENT DOCUMENTS 3,368,964 A * 2/1968 Chin ..... C10G 47/36 208/60
4,285,481 A 8/1981 Biscomb
4,455,614 A 6/1984 Martz et al.
5,039,396 A * 8/1991 Steinberg ..... C10G 45/00 208/143
5,384,489 A 1/1995 Bellac
5,481,145 A 1/1996 Canders et al.
6,265,453 B1 7/2001 Kennedy
6,354,084 B1 3/2002 McKinley et al.
6,554,994 B1 * 4/2003 Reynolds ..... B01J 8/0453 208/210
6,681,155 B1 1/2004 Fujita et al.
6,898,540 B2 5/2005 Davies
7,062,359 B2 6/2006 Bjorklund
7,757,493 B2 7/2010 Bell et al.
7,948,101 B2 5/2011 Burtch
8,404,918 B2 3/2013 Frey
8,510,015 B2 8/2013 Beausoleil et al.
8,763,625 B1 7/2014 Carter
8,967,590 B2 3/2015 Minervini et al.
9,085,499 B2 7/2015 Frey et al.
9,235,228 B2 1/2016 Gazit et al.
9,677,015 B2 6/2017 Gupta et al.
9,752,460 B2 9/2017 Bowan
9,764,272 B2 9/2017 Martin et al.
10,246,645 B2 4/2019 Froehle et al.
10,260,415 B2 4/2019 Simpkin et al.
2005/0034463 A1 2/2005 Simpson et al.
2006/0056120 A1 3/2006 Kawamura et al.
2006/0131212 A1 * 6/2006 Dahlberg ..... C10G 65/10 208/59
2008/0015839 A1 1/2008 Noureldin et al.
2009/0125152 A1 5/2009 Skowronski et al.
2011/0077448 A1 3/2011 Frey
2011/0100004 A1 5/2011 Al-Mazeedi
2012/0107227 A1 5/2012 Fischer et al.
2012/0118526 A1 5/2012 Sudau et al.
2012/0227440 A1 9/2012 Guidati et al.
2012/0245754 A1 9/2012 Mehnert
2012/0260667 A1 10/2012 Chillar et al.
2012/0326443 A1 12/2012 Ginter et al.
2013/0019530 A1 1/2013 Favilli et al.
2013/0199185 A1 8/2013 Wain et al.
2014/0331672 A1 11/2014 Filippi et al.
2015/0118131 A1 4/2015 Martin et al.
2016/0079756 A1 3/2016 Ikeyama et al.
2016/0141878 A1 5/2016 Johansen
(Continued)

FOREIGN PATENT DOCUMENTS

CN 102203780 A 9/2011
CN 103917280 A 7/2014
(Continued)

OTHER PUBLICATIONS

Tsourapas, Vasilios, Control Analysis of Integrated Fuel Cell Systems with Energy Recuperation Devices, 2007.
The Elliot Group, Maximize the Efficiency of your Steam Process, 2014.
Mechanical Solutions, Inc., Replacing a Pressure Reducing Valve with a Hydro Turbine for a Municipal Water Supply, Jul. 19, 2016.
Frey, Stanley Joseph, et al., U.S. Appl. No. 15/923,990, filed Mar. 16, 2018 and entitled , "Turbine with Supersonic Separation".
Frey, Stanley J., et al., U.S. Appl. No. 62/644,086, filed Mar. 16, 2018 and entitled "System for Consolidation and Use of Power Recovered from a Turbine in a Process Unit".
Frey, Stanley J., et al., U.S. Appl. No. 62/644,104, filed Mar. 16, 2018 and entitled "System for Power Recovery from Quench and Dilution Vapor Streams".
(Continued)

*Primary Examiner* — Randy Boyer

(57) ABSTRACT

Methods and apparatus for recovering power in a hydroprocessing process are described. The method involves the use of a power-recovery turbine in place of, or in addition to, a control valve. A hydrocarbon feed stream is combined with a portion of a hydrogen stream. The combined stream is heated, and the heated stream is introduced into a hydroprocessing reaction zone having at least two beds. The heated stream is contacted with a first hydroprocessing catalyst to form a first hydroprocessed stream. At least part of a portion of the hydrogen stream is combined with the first hydroprocessed stream to form a first quenched hydroprocessed stream. The first quenched hydroprocessed stream is contacted with a second hydroprocessing catalyst to form a second hydroprocessed stream. At least a portion of the second portion of the hydrogen stream is directed through a power-recovery turbine to generate electric power.

24 Claims, 2 Drawing Sheets

(56) References Cited

U.S. PATENT DOCUMENTS

| | | | |
|---|---|---|---|
| 2016/0161536 | A1 | 6/2016 | Amminudin |
| 2016/0252015 | A1 | 9/2016 | Kusumi et al. |
| 2016/0319198 | A1 | 11/2016 | Quanci et al. |
| 2017/0058206 | A1 | 3/2017 | Noureldin et al. |
| 2017/0058207 | A1 | 3/2017 | Noureldin et al. |
| 2019/0199128 | A1 | 6/2019 | Neufeld et al. |

FOREIGN PATENT DOCUMENTS

| | | | | |
|---|---|---|---|---|
| CN | 104463341 | A | 3/2015 | |
| CN | 206538206 | | 10/2017 | |
| EP | 0552039 | | 7/1993 | |
| EP | 2778354 | A1 | 9/2014 | |
| FR | 2414162 | | 8/1979 | |
| RU | 2014114067 | | 10/2015 | |
| WO | 2007105976 | A1 | 9/2007 | |
| WO | 2007053036 | A1 | 10/2007 | |
| WO | 2012128928 | A1 | 9/2012 | |
| WO | 2013148175 | A1 | 10/2013 | |
| WO | 2014119569 | A1 | 8/2014 | |
| WO | 2014178079 | A2 | 11/2014 | |
| WO | 2015065949 | A1 | 5/2015 | |
| WO | 2016177376 | A1 | 11/2016 | |
| WO | 2018005184 | A1 | 1/2018 | |
| WO | WO-2018005184 | A1 * | 1/2018 | ..... C10G 7/00 |

OTHER PUBLICATIONS

Frey, Stanley Joseph, et al., U.S. Appl. No. 15/924,037, filed Mar. 16, 2018 and entitled "Power Recovery from Quench and Dilution Vapor Streams".

Frey, Stanley J., U.S. Appl. No. 15/923,936, filed Mar. 16, 2018 and entitled "Energy-Recovery Turbines for Gas Streams".

Frey, Stanley J., et al., U.S. Appl. No. 15/923,945, filed Mar. 16, 2018 and entitled "Consolidation and Use of Power Recovered from a Turbine in a Process Unit".

Harris, James W., et al., U.S. Appl. No. 15/924,034, filed Mar. 16, 2018 and entitled "Use of Recovered Power in a Process".

Frey, Stanley J., et al., U.S. Appl. No. 15/923,964, filed Mar. 16, 2018 and entitled "Process Improvement through the Addition of Power Recovery Turbine Equipment in Existing Processes".

Harris, James W., et al., U.S. Appl. No. 15/923,995, filed Mar. 16, 2018 and entitled "Steam Reboiler with Turbine".

Frey, Stanley Joseph, et al., U.S. Appl. No. 15/923,997, filed Mar. 16, 2018 and entitled "Processes for Adjusting at Least One Process Condition of a Chemical Processing Unit with a Turbine".

International Search Report from corresponding PCT application No. PCT/US2019/022420, dated Jun. 20, 2019.

Written Opinion from corresponding PCT application No. PCT/US2019/022420, dated May 7, 2019.

Mohammadzadeh, Ashkan, et al., Design of a wind turbine model for clean energy. Case study: Khorasan Razavi regional electricity company, Acta Technica, 62, No. 4B/2017-1-8, (2017).

Guitiérrez-Antonio, Claudia, et al, Intensification of the hydrotreating process to produce renewable aviation fuel through reactive distillation, Science Direct, vol. 124, Feb. 2018.

* cited by examiner

HYDROPROCESSING UNIT WITH POWER RECOVERY TURBINES

BACKGROUND

In hydroprocessing units, hydrogen is recycled to multiple points in the hydroprocessing reactor. A portion of the hydrogen recycle flow goes with the feed at the reactor inlet after being heated to 300° C.-400° C. via heat exchange with the reactor effluent and heating typically through a fired heater to provide hydrogen for the reactions, and a heat sink to minimize the temperature increase in the reactor as the highly exothermic desulfurization, denitrification, saturation, and hydrocracking reactions generate heat. In most cases where the hydroprocessed feed is diesel range or heavier, the rest of the recycled hydrogen is added to points along the length of the reactor at temperatures typically less than 100° C. The addition points are between catalyst beds where the temperature has risen to levels that are undesirable due to increased catalyst deactivation rates, increased cracking to gas compounds, and increased possibility of runaway. The added hydrogen is at temperatures colder than the reactor stream by 200° C.-350° C. to cool the stream back down to an acceptable range. In many operating units, the throughput is actually limited by the amount of cooling available from these added hydrogen quench streams to keep the reactor temperatures in a safe range.

Moreover the conventional design compresses all the recycle hydrogen up to the pressure required to get the hydrogen through all the reactor feed heating equipment and the entire length of the reactor even though a large fraction of this hydrogen bypasses the heating section and sections of the reactor as it is used as quench thereby wasting the energy that was added to the recycle gas from the compressor across the quench hydrogen temperature control valves. Only compressing the reactor inlet hydrogen and quench hydrogen streams to the pressure that is required to save compressor power is typically not done in design because it adds unnecessary complication to the compressor, and the flows need to be changed during a catalyst cycle in any event because the catalyst deactivates and shifts the temperature increase to bed further into the reactor.

Therefore, there is a need for an improved hydroprocessing method.

DETAILED DESCRIPTION

Figure 1:
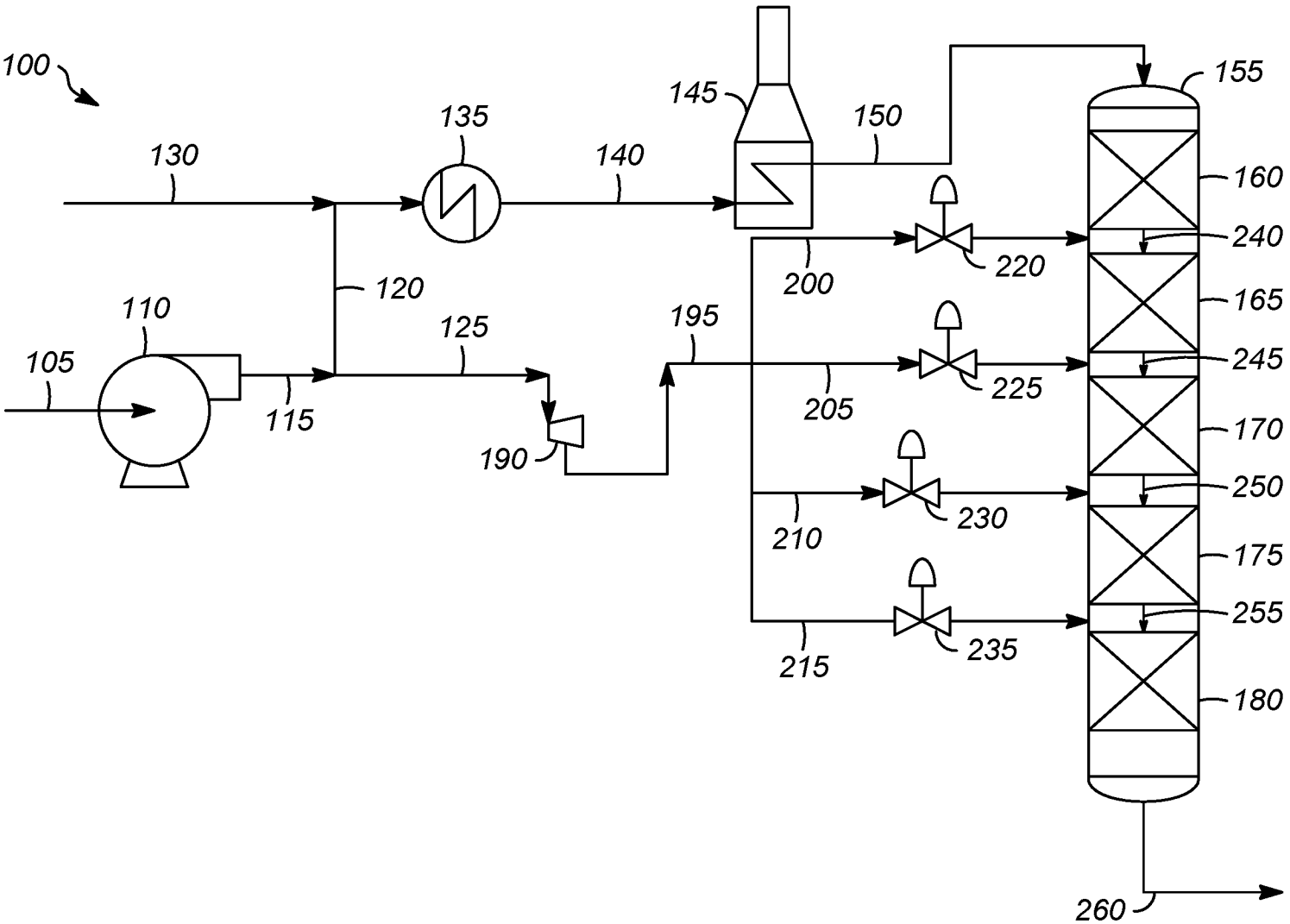
FIG. 1 is an illustration of one embodiment of the process of the present invention.

Installing turbines in the quench hydrogen lines in parallel with the existing temperature control valves (TCV) will provide a substantial amount of electrical power from energy that was otherwise dissipated through the valve. Moreover, the turbine will further cool the hydrogen from the temperature at the compressor outlet essentially providing "free refrigeration". This in turn will provide more cooling duty for the same amount of quench hydrogen flow and allow more feed to be sent to a hydroprocessing reaction zone that is limited by quench gas. A feed capacity increase in the range of 5% is possible due to the colder quench hydrogen with the turbine system paying for itself with the electricity generated.

The turbines could be directly coupled to drive a pump or compressor; however, given the number of additional pieces of equipment (in the way of couplings, clutches, bearing systems, gear boxes, etc.) needed, direct generation of electricity would likely be more convenient.

In some embodiments, the power-recovery turbine can be used to replace control valves in new or existing plants. In this case, the power-recovery turbine would control the flow of the hydrogen stream. In other embodiments, the power-recovery turbine could be added in parallel with a control valve. In this case, either the power-recovery turbine or the control valve could be used as the primary flow control element for the hydrogen stream.

When the power-control turbines are put in parallel with the TCV's, the TCV could take over the flow control if the power-recovery turbine became unavailable. It is also possible to base load the power-recovery turbine and have the TCV doing trim control for a more constant flow, allowing a more precise and high efficiency turbine design.

In some embodiments, the process for controlling a flowrate of and recovering energy from a process stream in a processing unit comprises directing a portion of the process stream through one or more variable-resistance power-recovery turbines to control the flowrate of the process stream using a variable nozzle turbine, inlet variable guide vanes, or direct coupled variable electric load, to name a few, to vary the resistance to flow through the turbine.

The resistance to rotation of the variable-resistance turbine can be varied by an external variable load electric circuit which is in a magnetic field from a magnet(s) that is rotating on the turbine. As more load is put on the circuit, there is more resistance to rotation on the turbine. This in turn imparts more pressure drop across the turbine and slows the process stream flow. An algorithm in the device can also calculate the actual flow through the device by measuring the turbine RPM's and the load on the circuit. The resistance to rotation flow can also be varied by variable position inlet guide vanes. In some embodiments, the power will be generated via power-recovery turbines with variable resistance to flow made possible by either guide vanes or variable load on the electrical power generation circuit. An algorithm to calculate actual flow using the guide vanes position, power output and RPM's can be used.

It is desirable for the power-recovery turbine to have the ability to control flow itself in order to extract the maximum amount of power from the full pressure drop from the compressor outlet to the reactor. Multiple turbines could be economically constructed on one platform for fast and simple installation with the quench lines being run to come to and from the multi-turbine skid. This type of longer responding, high inertia temperature control system is well matched with possible slower control action of a variable flow resistance turbine than a control valve. If slow control response of the turbine is an issue, then the use of the turbine is limited to slow responding or "loose" control point applications. A slow responding application is contemplated to have a response time to reach half way (i.e., 50% of a difference) between a new (or target) steady state condition (e.g., temperature, pressure, flow rate) from an original (or starting) steady state condition when the new (or target) condition differs from the original (or stating) condition of at least 10%, of at least one second, or even greater, for example, ten seconds, at least one minute, at least ten minutes, or an hour or more, for half of the change to completed.

A compact turbine system such as shown in U.S. Pat. No. 5,481,145 would be particularly useful for this application due to its compact size, simplicity of operation, and low need for infrastructure. An upstream filter on the line would likely be required to protect the turbine from any dust.

Alternatively, a single turbine could be put on the entire hydrogen quench gas stream before it branches to the individual bed to minimize capital cost. In this case, some of the potential power generation is lost because of the need for pressure drop to be taken across the downstream valves (if present) and the pressure drop along the reactor to not be exploited.

One aspect of the invention is a method for recovering power in a hydroprocessing process. The method includes combining a hydrocarbon feed stream with a first portion of a hydrogen stream to form a combined feed stream. The combined feed stream is heated, and the heated combined feed stream is introduced into a hydroprocessing reaction zone having at least two hydroprocessing beds. The combined heated feed stream is contacted with a first hydroprocessing catalyst at first hydroprocessing conditions to form a first hydroprocessed stream. At least a first part of a second portion of the hydrogen stream is combined with the first hydroprocessed stream to form a first quenched hydroprocessed stream. The first quenched hydroprocessed stream is contacted with a second hydroprocessing catalyst at second hydroprocessing conditions to form a second hydroprocessed stream. At least a portion of the at least second portion of the hydrogen stream is directed through a power-recovery turbine to generate electric power therefrom.

In some embodiments, the flow rate of the at least the second portion of the hydrogen stream is controlled using a control valve, or the power-recovery turbine, or both.

In some embodiments, the portion of the second portion of the hydrogen stream that is directed through the power-recovery turbine comprises at least the first part of the second portion, which is then combined with the first hydroprocessed stream.

In some embodiments, the hydroprocessing reaction zone comprises at least three hydroprocessing beds. A second part of the second portion of the hydrogen stream is combined with the second hydroprocessed stream to form a second quenched hydroprocessed stream. The second quenched hydroprocessed stream is contacted with a third hydroprocessing catalyst at third hydroprocessing conditions to form a third hydroprocessed stream. The first and second parts of the second portion of the hydrogen stream are formed by dividing the second portion of the hydrogen stream into at least two parts after the second portion of the hydrogen stream is directed through the power-recovery turbine. In some embodiments, at least one of the flow of the first part of the second portion of the hydrogen stream is controlled using a first control valve, or the power recovery turbine, or both; and the flow of the second part of the second portion of the hydrogen stream is controlled using a second control valve, or the power recovery turbine, or both.

In some embodiments, the hydroprocessing reaction zone comprises at least three hydroprocessing beds, and there are at least two power-recovery turbines. A second part of the second portion of the hydrogen stream is combined with the second hydroprocessed stream to form a second quenched hydroprocessed stream. The second quenched hydroprocessed stream is contacted with a third hydroprocessing catalyst at third hydroprocessing conditions to form a third hydroprocessed stream. The second portion of the hydrogen stream is divided into at least two parts and wherein at least a fraction of the first part is directed through a first power-recovery turbine, and wherein at least a fraction of the second part is directed through a second power-recovery turbine. In some embodiments, at least one of the flow of a second fraction of the first part of the second portion of the hydrogen stream is controlled using a first control valve, or the first power recovery turbine, or both; and the flow of a second fraction of second part of the second portion of the hydrogen stream is controlled using a second control valve, or the second power recovery turbine, or both.

In some embodiments, the hydrogen stream is a recycle hydrogen stream.

In some embodiments, the electric power generated by the power-recovery turbine is direct current.

In some embodiments, the power-recovery turbine is the primary flow control element on the portion of the hydrogen stream sent to the hydroprocessing reaction zone as quench between hydroprocessing beds. In other embodiments, a control valve is the primary flow control element on the portion of the hydrogen stream sent to the hydroprocessing reaction zone as quench between hydroprocessing beds. In some embodiments, power-recovery turbines are the primary flow control devices on the individual branches of the hydrogen stream sent to the hydroprocessing reaction zone as quench between hydroprocessing beds. In other embodiments, flow control valves are the primary flow control devices on the individual branches of the hydrogen stream sent to the hydroprocessing reaction zone as quench between hydroprocessing beds.

One effect of directing the hydrogen gas flow through the power-recovery turbine is the reduction in temperature of the hydrogen. The hydrogen stream exiting the power-recovery turbine outlet is at a lower temperature than the hydrogen stream exiting a control valve at the same outlet pressure. This occurs because the turbine extracts more energy from the hydrogen stream than does the control valve. The turbine approximates an isentropic expansion with loss of mechanical and thermal energy to drive the turbine. This as compared to an adiabatic, highly irreversible expansion through a valve where the pressure drop is conducted without any energy extracted or heat transferred from the system. The lower temperature from the turbine will enable the cooling between reactor beds to be accomplished with less hydrogen than for the valve case which results in a higher outlet temperature. This lower hydrogen flow requirement can enable either energy savings in the compression section for the hydrogen or, alternatively, the hydrocarbon feed rate to a reactor limited by a high temperatures could be increased as the temperature limitation will be somewhat relieved due to the lower temperature hydrogen quench stream. Hydroprocessing reactor beds typically have high temperature limits to avoid the possibility of auto propagation of heat release as unwanted methanation and increased cracking reactions can start to increase temperature catastrophically rapidly once started.

In some embodiments, the process variable change response time to reach 50% of a new setpoint value after a setpoint change of 10% is at least ten seconds. In other embodiments, the process variable change response time to reach 50% of a new setpoint value after a setpoint change of 10% is at least one second.

In some embodiments, the method includes control steps. In some embodiments, the method includes receiving information from a plurality of pressure reducing devices, the plurality of pressure reducing devices comprising: one or more power-recovery turbines; a control valve; or, both; determining a power loss value or a power generated value for each of the pressure reducing devices; determining a total power loss value or a total power generated value based upon the power loss values or the power generated values from each of the pressure reducing devices; and, displaying the total power loss value or the total power generated value on at least one display screen.

In some embodiments, the method includes adjusting at least one process parameter in the hydroprocessing reaction zone based upon the total power loss value or the total power generated value.

In some embodiments, the method includes, after the process parameter has been adjusted, determining an updated power loss value or an updated power generated value for each of the pressure reducing devices; determining an updated total power loss value or an updated total power generated value for the hydroprocessing reaction zone based upon the updated power loss values or the updated power generated values from each of the pressure reducing devices; and, displaying the updated total power loss value or the updated total power generated value on at least one display screen.

In some embodiments, the method includes receiving information associated with conditions outside of the hydroprocessing reaction zone, wherein the total power loss value or the total power generated value is determined based in part upon the information associated with conditions outside of the hydroprocessing reaction zone.

In some embodiments, the method includes receiving information associated with a throughput of the hydroprocessing reaction zone, wherein the total power loss value or the total power generated value is determined based in part upon the information associated with the throughput of the hydroprocessing reaction zone.

In some embodiments, the method includes maintaining the throughput of the hydroprocessing reaction zone while adjusting the at least one process parameter of the portion of a hydroprocessing reaction zone based upon the total power loss value or the total power generated value.

Another aspect of the invention is an apparatus for recovering power in a hydroprocessing reaction zone. In one embodiment, the apparatus comprises a hydroprocessing reaction zone having at least two hydroprocessing beds, a feed inlet, a hydrogen inlet, and an outlet, the hydrogen inlet positioned between the at least two hydroprocessing beds; a charge heater in fluid communication with the feed inlet; a hydrogen line in fluid communication with the hydrogen inlet; and a power-recovery turbine in fluid communication with the hydrogen line.

In some embodiments, the hydroprocessing reaction zone has at least three hydroprocessing beds and at least two hydrogen inlets, wherein the hydrogen line is divided into at least two parts downstream of the power-recovery turbine forming at least a first line and a second line, wherein the first line is in fluid communication with the first hydrogen inlet, and wherein the second line is in fluid communication with the second hydrogen inlet.

In some embodiments, the apparatus further comprises a control valve on at least one of the first and second lines.

In some embodiments, the hydroprocessing reaction zone has at least three hydroprocessing beds and at least two hydrogen inlets, wherein the hydrogen line is divided into at least two parts upstream of the power-recovery turbine forming at least a first line and a second line, wherein there is a first power-recovery turbine in fluid communication with the first line and a second power-recovery turbine in fluid communication with the second line, and wherein the first line is in fluid communication with the first hydrogen inlet, and wherein the second line is in fluid communication with the second hydrogen inlet.

In some embodiments, the apparatus further comprises a first control valve in fluid communication with the first line and arranged in parallel with the first power-recovery turbine and a second control valve in fluid communication with the first line and arranged in parallel with the second power-recovery turbine.

FIG. 1 illustrates one embodiment of the process 100. Hydrogen stream 105 is compressed in compressor 110. The compressed hydrogen stream 115 is split into two portions, first and second hydrogen streams 120 and 125. First hydrogen stream 120 is combined with the hydrocarbon feed stream 130 and sent through heat exchanger 135 to raise the temperature. The partially heated feed stream 140 is sent to fired heater 145 to raise the temperature of the heated feed stream 150 exiting the fired heater 145 to the desired inlet temperature for the hydroprocessing reaction zone 155.

Second hydrogen stream 125 is sent to a power-recovery turbine 190 generating power and reducing the pressure of the second hydrogen stream 125. The reduced pressure hydrogen stream 195 is divided into four parts, hydrogen quench streams 200, 205, 210, 215. Each of the hydrogen quench streams 200, 205, 210, 215 has an associated control valve 220, 225, 230, 235 to control the flow of hydrogen entering the hydroprocessing bed.

As shown, hydroprocessing reaction zone 155 has five hydroprocessing beds 160, 165, 170, 175, and 180. Heated feed stream 150, which contains hydrogen and hydrocarbon feed to be hydroprocessed, enters the first hydroprocessing bed 160 where it undergoes hydroprocessing. The effluent from the first hydroprocessing bed 160 is mixed with first hydrogen quench stream 200 to form first quenched hydroprocessed stream 240.

The first quenched hydroprocessed stream 240 is sent to the second hydroprocessing bed 165 where it undergoes further hydroprocessing. The effluent from the second hydroprocessing bed 165 is mixed with second hydrogen quench stream 205 to form second quenched hydroprocessed stream 245.

The second quenched hydroprocessed stream 245 is sent to the third hydroprocessing bed 170 where it undergoes further hydroprocessing. The effluent from the third hydroprocessing bed 170 is mixed with third hydrogen quench stream 210 to form third quenched hydroprocessed stream 250.

The third quenched hydroprocessed stream 250 is sent to the fourth hydroprocessing bed 175 where it undergoes further hydroprocessing. The effluent from the fourth hydroprocessing bed 175 is mixed with fourth hydrogen quench stream 215 to form fourth quenched hydroprocessed stream 255.

The fourth quenched hydroprocessed stream 255 is sent to the fifth hydroprocessing bed 180 where it undergoes further hydroprocessing. The effluent 260 from the fifth hydroprocessing bed 180 can be sent to various processing zones, such as heat exchange with the feed, water wash to dissolve and extract salts, vapor liquid separation, stripping, second stage hydroprocessing, distillation and amine treating in many combinations.

In this embodiment, the effluent would first go to heat exchange with the feed, water wash to extract and dissolve salts, air or water cooled condensing heat exchange, vapor liquid separation to provide recycle gas and liquid to subsequent stripping, and distillative fractionation. The recycle gas stream would be amine treated to remove hydrogen sulfide, combined with make-up hydrogen before or after recompression in the recycle gas compressor and returned to the reactor via the combining with the reactor inlet hydrocarbon stream or as quench gas streams along the length of the reactor.

Figure 2:
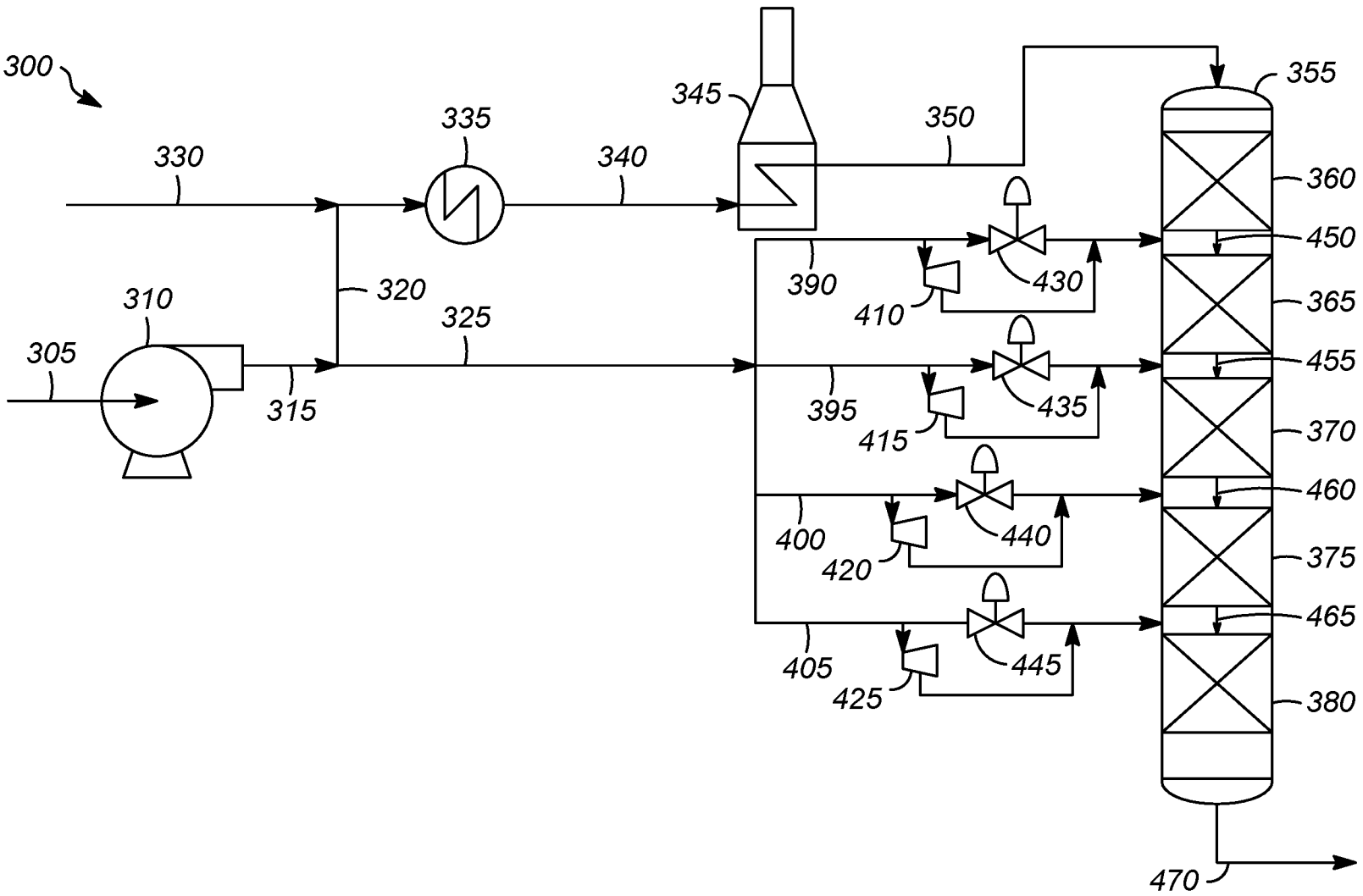
FIG. 2 is an illustration of another embodiment of the process of the present invention.

FIG. 2 illustrates another embodiment of the process 300. Hydrogen stream 305 is compressed in compressor 310. The compressed hydrogen stream 315 is split into first and second portions, hydrogen streams 320 and 325. First hydrogen stream 320 is mixed with the hydrocarbon feed stream 330 and sent through heat exchanger 335 to raise the temperature. The partially heated feed stream 340 is sent to fired heater 345 to raise the temperature of the feed stream 350 exiting the fired heater 345 to the desired inlet temperature for the hydroprocessing reaction zone 355.

Second hydrogen stream 325 is divided into four hydrogen quench streams 390, 395, 400, 405. Each of the hydrogen quench streams 390, 395, 400, 405 has a power-recovery turbine 410, 415, 420, 425 to generate power and control the flow of hydrogen entering the hydroprocessing bed as well as a control valve 430, 435, 440, 445 to control the flow of hydrogen entering the hydroprocessing bed.

Hydrogen quench streams 390, 395, 400, 405 can be directed through either the power-recovery turbine 410, 415, 420, 425, the control valve 430, 435, 440, 445, or both. For example, a first fraction of first hydrogen quench stream 390 can be directed to the power-recovery turbine 410, and a second fraction can be directed to the control valve 430. The first fraction can vary from 0% to 100% and the second fraction can vary from 100% to 0%. Thus, the flow of the hydrogen quench streams 390, 395, 400, 405 can be controlled by the power-recovery turbines 410, 415, 420, 425, the control valves 430, 435, 440, 445, or both, allowing excellent process flexibility in systems including both.

As shown, hydroprocessing reaction zone 355 has five hydroprocessing beds 360, 365, 370, 375, and 380. Feed stream 350, which contains hydrogen and hydrocarbon feed to be hydroprocessed, enters the first hydroprocessing bed 360 where it undergoes hydroprocessing. The effluent from the first hydroprocessing bed 360 is mixed with first hydrogen quench stream 390 to form first quenched hydroprocessed stream 450.

The first quenched hydroprocessed stream 450 is sent to the second hydroprocessing bed 365 where it undergoes further hydroprocessing. The effluent from the second hydroprocessing bed 365 is mixed with second hydrogen quench stream 395 to form second quenched hydroprocessed stream 455.

The second quenched hydroprocessed stream 455 is sent to the third hydroprocessing bed 370 where it undergoes further hydroprocessing. The effluent from the third hydroprocessing bed 370 is mixed with third hydrogen quench stream 400 to form third quenched hydroprocessed stream 460.

The third quenched hydroprocessed stream 460 is sent to the fourth hydroprocessing bed 375 where it undergoes further hydroprocessing. The effluent from the fourth hydroprocessing bed 375 is mixed with fourth hydrogen quench stream 405 to form fourth quenched hydroprocessed stream 465.

The fourth quenched hydroprocessed stream 465 is sent to the fifth hydroprocessing bed 380 where it undergoes further hydroprocessing. The effluent 470 from the fifth hydroprocessing bed 380 can be sent to various processing zones, as described above.

In this embodiment, the effluent would first go to heat exchange with the feed, water wash to extract and dissolve salts, air or water cooled condensing heat exchange, vapor liquid separation to provide recycle gas and liquid to subsequent stripping, and distillative fractionation. The recycle gas stream would be amine treated to remove hydrogen sulfide, combined with make-up hydrogen before or after recompression in the recycle gas compressor and returned to the reactor via the combining with the reactor inlet hydrocarbon stream or as quench gas streams along the length of the reactor.

The devices and processes of the present invention are contemplated as being utilized in a hydroprocessing reaction zone. As is known, such hydroprocessing reaction zones utilize a process control system, typically on a computer in a control center.

The process control system described in connection with the embodiments disclosed herein may be implemented or performed on the computer with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, or, the processor may be any conventional processor, controller, microcontroller, or state machine. A processor may also be a combination of computing devices, e.g., a combination of a DSP and a microprocessor, two or more microprocessors, or any other combination of the foregoing.

The steps of the processes associated with the process control system may be embodied in an algorithm contained directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is in communication with the processor reading information from, and writing information to, the storage medium. This includes the storage medium being integral to or with the processor. The processor and the storage medium may reside in an ASIC. The ASIC may reside in a user terminal. Alternatively, the processor and the storage medium may reside as discrete components in a user terminal. These devices are merely intended to be exemplary, non-limiting examples of a computer readable storage medium. The processor and storage medium or memory are also typically in communication with hardware (e.g., ports, interfaces, antennas, amplifiers, signal processors, etc.) that allow for wired or wireless communication between different components, computers processors, or the like, such as between the input channel, a processor of the control logic, the output channels within the control system and the operator station in the control center.

In communication relative to computers and processors refers to the ability to transmit and receive information or data. The transmission of the data or information can be a wireless transmission (for example by Wi-Fi or Bluetooth) or a wired transmission (for example using an Ethernet RJ45 cable or an USB cable). For a wireless transmission, a wireless transceiver (for example a Wi-Fi transceiver) is in communication with each processor or computer. The transmission can be performed automatically, at the request of the computers, in response to a request from a computer, or in other ways. Data can be pushed, pulled, fetched, etc., in any combination, or transmitted and received in any other manner.

Therefore, it is contemplated that the process control system receives information from the power-recovery turbine 190 or 410, 415, 420, 425 relative to an amount of electricity generated by the power-recovery turbine 190 or 410, 415, 420, 425. It is contemplated that the power-recovery turbine 190 or 410, 415, 420, 425 determines (via the processor) the amount of electricity it has generated. Alternatively, the process control system receiving the information determines the amount of electricity that has been generated by the power-recovery turbine 190 or 410, 415, 420, 425. In either configuration, the amount of the electricity generated by the power-recovery turbine 190 or 410, 415, 420, 425 is displayed on at least one display screen associated with the computer in the control center. If the hydroprocessing reaction zone comprises a plurality of power-recovery turbines 410, 415, 420, 425, it is further contemplated that the process control system receives information associated with the amount of electricity generated by each of the power-recovery turbines 410, 415, 420, 425. The process control system determines a total electrical power generated based upon the information associated with the each of the power-recovery turbines 410, 415, 420, 425 and displays the total electrical power generated on the display screen. The total electrical power generated may be displayed instead of, or in conjunction with, the amount of electrical power generated by the individual power-recovery turbines 190 or 410, 415, 420, 425.

As discussed above, the electrical energy recovered by the power-recovery turbines 190 or 410, 415, 420, 425 is often a result of removing energy from the streams that was added to the streams in the hydroprocessing compression zone. Thus, it is contemplated that the processes according to the present invention provide for the various processing conditions associated with the processing reaction and compression zone to be adjusted into order to lower the energy added to the stream(s). The hydrogen leaving the hydrogen compression section is compressed to a pressure so that the flow can be controlled to the higher pressure reactor combined feed heat exchangers and the feed furnace and first reaction bed in addition to each hydrogen stream between beds. The turbine power recoveries between beds may signal on opportunity to decrease the compressor outlet pressure while still maintaining the flow control as the energy recovered from the power-recovery turbines is set above the experientially determined economically optimum amount. In this way the turbines can signal an opportunity to save even more energy than recovering it in the turbine but instead never add a portion of that energy to the system in the first place.

It is contemplated that the process control system receives information associated with the throughput of the hydroprocessing reaction zone, and determines a target electrical power generated value for the turbine(s) since the electricity represents energy that is typically added to the overall hydroprocessing reaction zone. The determination of the target electrical power generated value may be done when the electricity is at or near a predetermined level. In other words, if the amount of electricity produced meets or exceeds a predetermined level, the process control system can determine one or more processing conditions to adjust and lower the amount of electricity generated until it reaches the target electrical power generated value.

Thus, the process control system will analyze one or more changes to the various processing conditions associated with the hydroprocessing reaction zone to lower the amount of energy recovered by the power-recovery turbines of the hydroprocessing reaction zone. Preferably, the processing conditions are adjusted without adjusting the throughput of the hydro processing zone. This allows for the hydroprocessing reaction zone to have the same throughput, but with a lower operating cost associated with the same throughput. The process control software may calculate and display the difference between the target electrical power generated value and the total electrical power generated on the display screen.

For example, the process control software may recognize that the total electrical power generated exceeds a predetermined level. Accordingly, the process control software may determine the target electrical power generated value. Based upon other data and information received from other sensors and data collection devices typically associated with the hydroprocessing reaction zone, the process control software may determine that the amount of fuel consumed in the heater can be lowered. While maintaining the throughput of the hydroprocessing reaction zone, the amount of fuel consumed in the heater is lowered. While this may lower the electricity generated by the power-recovery turbine, the lower fuel consumption provides a lower operating cost for the same throughput.

Thus, not only does the present invention convert energy that is typically lost into a form that is used elsewhere in the hydroprocessing reaction zone, the hydroprocessing reaction zones are provided with opportunities to lower the energy input associated with the overall hydroprocessing reaction zone and increase profits by utilizing more energy efficient processes.

It should be appreciated and understood by those of ordinary skill in the art that various other components, such as valves, pumps, filters, coolers, etc., were not shown in the drawings as it is believed that the specifics of same are well within the knowledge of those of ordinary skill in the art and a description of same is not necessary for practicing or understanding the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

Specific Embodiments

While the following is described in conjunction with specific embodiments, it will be understood that this description is intended to illustrate and not limit the scope of the preceding description and the appended claims.

A first embodiment of the invention is a method for recovering power in a hydroprocessing process comprising combining a hydrocarbon feed stream with a first portion of a hydrogen stream to form a combined feed stream; heating the combined feed stream; introducing the heated combined feed stream into a hydroprocessing reaction zone having at least two hydroprocessing beds; contacting the combined heated feed stream with a first hydroprocessing catalyst at first hydroprocessing conditions to form a first hydroprocessed stream; combining a first part of a second portion of the hydrogen stream with the first hydroprocessed stream to form a first quenched hydroprocessed stream; contacting the first quenched hydroprocessed stream with a second hydroprocessing catalyst at second hydroprocessing conditions to form a second hydroprocessed stream; directing at least a portion of the at least second portion of the hydrogen stream through a power-recovery turbine to generate electric power therefrom. An embodiment of the invention is one, any or all of prior embodiments in this paragraph up through the first embodiment in this paragraph further comprising controlling a flow rate of the at least the second portion of the hydrogen stream using a control valve, or the power-recovery turbine, or both. An embodiment of the invention is one, any or all of prior embodiments in this paragraph up through the first embodiment in this paragraph wherein the portion of the second portion comprises at least the first part of the second portion. An embodiment of the invention is one, any or all of prior embodiments in this paragraph up through the first embodiment in this paragraph wherein the hydroprocessing reaction zone comprises at least three hydroprocessing beds, and further comprising combining a second part of the second portion of the hydrogen stream with the second hydroprocessed stream to form a second quenched hydroprocessed stream; contacting the second quenched hydroprocessed stream with a third hydroprocessing catalyst at third hydroprocessing conditions to form a third hydroprocessed stream; wherein the first and second parts of the second portion of the hydrogen stream are formed by dividing the second portion of the hydrogen stream into at least two parts after the second portion of the hydrogen stream is directed through the power-recovery turbine. An embodiment of the invention is one, any or all of prior embodiments in this paragraph up through the first embodiment in this paragraph further comprising at least one of controlling a flow of the first part of the second portion of the hydrogen stream using a first control valve, or the power recovery turbine, or both; and controlling a flow of the second part of the second portion of the hydrogen stream using a second control valve, or the power recovery turbine, or both. An embodiment of the invention is one, any or all of prior embodiments in this paragraph up through the first embodiment in this paragraph wherein the hydroprocessing reaction zone comprises at least three hydroprocessing beds, and wherein there are at least two power-recovery turbines, and further comprising combining a second part of the second portion of the hydrogen stream with the second hydroprocessed stream to form a second quenched hydroprocessed stream; contacting the second quenched hydroprocessed stream with a third hydroprocessing catalyst at third hydroprocessing conditions to form a third hydroprocessed stream; wherein the second portion of the hydrogen stream is divided into at least two parts and wherein a fraction of the first part is directed through a first power-recovery turbine, and wherein at least a fraction of the second part is directed through a second power-recovery turbine. An embodiment of the invention is one, any or all of prior embodiments in this paragraph up through the first embodiment in this paragraph further comprising at least one of controlling a flow of a second fraction of the first part of the second portion of the hydrogen stream using a first control valve, or the first power recovery turbine, or both; and controlling a flow of a second fraction of second part of the second portion of the hydrogen stream using a second control valve, or the second power recovery turbine, or both. An embodiment of the invention is one, any or all of prior embodiments in this paragraph up through the first embodiment in this paragraph wherein the hydrogen stream is a recycle hydrogen stream. An embodiment of the invention is one, any or all of prior embodiments in this paragraph up through the first embodiment in this paragraph wherein the electric power generated by the power-recovery turbine is direct current. An embodiment of the invention is one, any or all of prior embodiments in this paragraph up through the first embodiment in this paragraph wherein a power recovery turbine is a primary flow control element for the flow of all of the second portion of the hydrogen stream. An embodiment of the invention is one, any or all of prior embodiments in this paragraph up through the first embodiment in this paragraph wherein a process variable change response time to reach 50% of a new setpoint value after a setpoint change of 10% is at least ten seconds. An embodiment of the invention is one, any or all of prior embodiments in this paragraph up through the first embodiment in this paragraph wherein a process variable change response time to reach 50% of a new setpoint value after a setpoint change of 10% is at least one second. An embodiment of the invention is one, any or all of prior embodiments in this paragraph up through the first embodiment in this paragraph wherein the power recovery turbines are a primary flow control element for the flow of the first and second parts of the second portion of the hydrogen stream. An embodiment of the invention is one, any or all of prior embodiments in this paragraph up through the first embodiment in this paragraph wherein a process variable change response time to reach 50% of a new setpoint value after a setpoint change of 10% is at least ten seconds. An embodiment of the invention is one, any or all of prior embodiments in this paragraph up through the first embodiment in this paragraph wherein a process variable change response time to reach 50% of a new setpoint value after a setpoint change of 10% is at least one second. An embodiment of the invention is one, any or all of prior embodiments in this paragraph up through the first embodiment in this paragraph wherein the second portion of the hydrogen stream is colder at the power recovery turbine outlet than at a control valve outlet at the same outlet pressure. An embodiment of the invention is one, any or all of prior embodiments in this paragraph up through the first embodiment in this paragraph wherein the second portion of the hydrogen stream is colder at the power recovery turbine outlet than at a control valve outlet at the same outlet pressure. An embodiment of the invention is one, any or all of prior embodiments in this paragraph up through the first embodiment in this paragraph further comprising receiving information from a plurality of pressure reducing devices, the plurality of pressure reducing devices comprising one or more power-recovery turbines, a control valve, or both; determining a power loss value or a power generated value for each of the pressure reducing devices; determining a total power loss value or a total power generated value based upon the power loss values or the power generated values from each of the pressure reducing devices; and, displaying the total power loss value or the total power generated value on at least one display screen. An embodiment of the invention is one, any or all of prior embodiments in this paragraph up through the first embodiment in this paragraph further comprising adjusting at least one process parameter in the hydroprocessing reaction zone based upon the total power loss value or the total power generated value. An embodiment of the invention is one, any or all of prior embodiments in this paragraph up through the first embodiment in this paragraph further comprising displaying, on at least one display screen, the total power loss value or the total power generated value. An embodiment of the invention is one, any or all of prior embodiments in this paragraph up through the first embodiment in this paragraph further comprising after the at least one process parameter has been adjusted, determining an updated power loss value or an updated power generated value for each of the pressure reducing devices; determining an updated total power loss value or an updated total power generated value for the hydroprocessing reaction zone based upon the updated power loss values or the updated power generated values from each of the pressure reducing devices; and displaying the updated total power loss value or the updated total power generated value on at least one display screen. An embodiment of the invention is one, any or all of prior embodiments in this paragraph up through the first embodiment in this paragraph further comprising receiving information associated with conditions outside of the hydroprocessing reaction zone, wherein the total power loss value or the total power generated value is determined based in part upon the information associated with conditions outside of the hydroprocessing reaction zone. An embodiment of the invention is one, any or all of prior embodiments in this paragraph up through the first embodiment in this paragraph further comprising receiving information associated with a throughput of the hydroprocessing reaction zone, wherein the total power loss value or the total power generated value is determined based in part upon the information associated with the throughput of the hydroprocessing reaction zone. An embodiment of the invention is one, any or all of prior embodiments in this paragraph up through the first embodiment in this paragraph further comprising maintaining the throughput of the hydroprocessing reaction zone while adjusting the at least one process parameter of the portion of a hydroprocessing reaction zone based upon the total power loss value or the total power generated value.

A second embodiment of the invention is an apparatus for recovering power in a hydroprocesser comprising a hydroprocessing reaction zone having at least two hydroprocessing beds, a feed inlet, a hydrogen inlet, and an outlet, the hydrogen inlet positioned between the at least two hydroprocessing beds; a charge heater in fluid communication with the feed inlet; a hydrogen line in fluid communication with the hydrogen inlet; a power-recovery turbine in fluid communication with the hydrogen line. An embodiment of the invention is one, any or all of prior embodiments in this paragraph up through the second embodiment in this paragraph wherein the hydroprocessing reaction zone has at least three hydroprocessing beds and at least two hydrogen inlets, wherein the hydrogen line is divided into at least two parts downstream of the power-recovery turbine forming at least a first line and a second line, wherein the first line is in fluid communication with the first hydrogen inlet, and wherein the second line is in fluid communication with the second hydrogen inlet. An embodiment of the invention is one, any or all of prior embodiments in this paragraph up through the second embodiment in this paragraph further comprising a control valve on at least one of the first and second lines. An embodiment of the invention is one, any or all of prior embodiments in this paragraph up through the second embodiment in this paragraph wherein the hydroprocessing reaction zone has at least three hydroprocessing beds and at least two hydrogen inlets, wherein the hydrogen line is divided into at least two parts upstream of the power-recovery turbine forming at least a first line and a second line, wherein there is a first power-recovery turbine in fluid communication with the first line and a second power-recovery turbine in fluid communication with the second line, and wherein the first line is in fluid communication with the first hydrogen inlet, and wherein the second line is in fluid communication with the second hydrogen inlet. An embodiment of the invention is one, any or all of prior embodiments in this paragraph up through the second embodiment in this paragraph further comprising a first control valve in fluid communication with the first line and arranged in parallel with the first power-recovery turbine and a second control valve in fluid communication with the first line and arranged in parallel with the second power-recovery turbine.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A method for recovering power in a hydroprocessing process comprising:

combining a hydrocarbon feed stream with a first portion of a hydrogen stream to form a combined feed stream;

heating the combined feed stream;

introducing the heated combined feed stream into a hydroprocessing reaction zone having at least two hydroprocessing beds;

contacting the combined heated feed stream with a first hydroprocessing catalyst at first hydroprocessing conditions to form a first hydroprocessed stream;

combining a first part of a second portion of the hydrogen stream with the first hydroprocessed stream to form a first quenched hydroprocessed stream;

contacting the first quenched hydroprocessed stream with a second hydroprocessing catalyst at second hydroprocessing conditions to form a second hydroprocessed stream;

directing at least a portion of the at least second portion of the hydrogen stream through a power-recovery turbine to generate electric power therefrom.

2. The method of claim 1 further comprising:

controlling a flow rate of the at least the second portion of the hydrogen stream using a control valve, or the power-recovery turbine, or both.

3. The method of claim 1 wherein the portion of the second portion comprises at least the first part of the second portion.

4. The method of claim 1 wherein the hydroprocessing reaction zone comprises at least three hydroprocessing beds, and further comprising:

combining a second part of the second portion of the hydrogen stream with the second hydroprocessed stream to form a second quenched hydroprocessed stream;

contacting the second quenched hydroprocessed stream with a third hydroprocessing catalyst at third hydroprocessing conditions to form a third hydroprocessed stream;

wherein the first and second parts of the second portion of the hydrogen stream are formed by dividing the second portion of the hydrogen stream into at least two parts after the second portion of the hydrogen stream is directed through the power-recovery turbine.

5. The method of claim 4 further comprising at least one of:

controlling a flow of the first part of the second portion of the hydrogen stream using a first control valve, or the power recovery turbine, or both; and controlling a flow of the second part of the second portion of the hydrogen stream using a second control valve, or the power recovery turbine, or both.

6. The method of claim 1 wherein the hydroprocessing reaction zone comprises at least three hydroprocessing beds, and wherein there are at least two power-recovery turbines, and further comprising:

combining a second part of the second portion of the hydrogen stream with the second hydroprocessed stream to form a second quenched hydroprocessed stream;

contacting the second quenched hydroprocessed stream with a third hydroprocessing catalyst at third hydroprocessing conditions to form a third hydroprocessed stream;

wherein the second portion of the hydrogen stream is divided into at least two parts and wherein a fraction of the first part is directed through a first power-recovery turbine, and wherein at least a fraction of the second part is directed through a second power-recovery turbine.

7. The method of claim 6 further comprising at least one of:

controlling a flow of a second fraction of the first part of the second portion of the hydrogen stream using a first control valve, or the first power recovery turbine, or both; and controlling a flow of a second fraction of second part of the second portion of the hydrogen stream using a second control valve, or the second power recovery turbine, or both.

8. The method of claim 1 wherein the hydrogen stream is a recycle hydrogen stream.

9. The method of claim 1 wherein the electric power generated by the power-recovery turbine is direct current.

10. The method of claim 1 wherein a power recovery turbine is a primary flow control element for the flow of all of the second portion of the hydrogen stream.

11. The method of claim 10 wherein a process variable change response time to reach 50% of a new setpoint value after a setpoint change of 10% is at least ten seconds.

12. The method of claim 10 wherein a process variable change response time to reach 50% of a new setpoint value after a setpoint change of 10% is at least one second.

13. The method of claim 6 wherein the power recovery turbines are a primary flow control element for the flow of the first and second parts of the second portion of the hydrogen stream.

14. The method of claim 13 wherein a process variable change response time to reach 50% of a new setpoint value after a setpoint change of 10% is at least ten seconds.

15. The method of claim 13 wherein a process variable change response time to reach 50% of a new setpoint value after a setpoint change of 10% is at least one second.

16. The method of claim 1 wherein the second portion of the hydrogen stream is colder at the power recovery turbine outlet than at a control valve outlet at the same outlet pressure.

17. The method of claim 4 wherein the second portion of the hydrogen stream is colder at the power recovery turbine outlet than at a control valve outlet at the same outlet pressure.

18. The method of claim 1 further comprising:

receiving information from a plurality of pressure reducing devices, the plurality of pressure reducing devices comprising: one or more power-recovery turbines; a control valve; or, both;

determining a power loss value or a power generated value for each of the pressure reducing devices;

determining a total power loss value or a total power generated value based upon the power loss values or the power generated values from each of the pressure reducing devices; and, displaying the total power loss value or the total power generated value on at least one display screen.

19. The method of claim 18 further comprising adjusting at least one process parameter in the hydroprocessing reaction zone based upon the total power loss value or the total power generated value.

20. The method of claim 18 further comprising displaying, on at least one display screen, the total power loss value or the total power generated value.

21. The method of claim 18 further comprising:

after the at least one process parameter has been adjusted, determining an updated power loss value or an updated power generated value for each of the pressure reducing devices;

determining an updated total power loss value or an updated total power generated value for the hydroprocessing reaction zone based upon the updated power loss values or the updated power generated values from each of the pressure reducing devices; and, displaying the updated total power loss value or the updated total power generated value on at least one display screen.

22. The method of claim 18 further comprising:

receiving information associated with conditions outside of the hydroprocessing reaction zone, wherein the total power loss value or the total power generated value is determined based in part upon the information associated with conditions outside of the hydroprocessing reaction zone.

23. The method of claim 18 further comprising:

receiving information associated with a throughput of the hydroprocessing reaction zone, wherein the total power loss value or the total power generated value is determined based in part upon the information associated with the throughput of the hydroprocessing reaction zone.

24. The method of claim 23 further comprising:

maintaining the throughput of the hydroprocessing reaction zone while adjusting the at least one process parameter of the portion of a hydroprocessing reaction zone based upon the total power loss value or the total power generated value.

* * * * *